US005303902A

United States Patent [19]

Forte et al.

[11] Patent Number: 5,303,902

[45] Date of Patent: Apr. 19, 1994

[54] SLAG CONTROL SHAPE RELEASE APPARATUS FOR MOLTEN METAL VESSELS

[75] Inventors: Gary L. Forte, Plymouth; James P. McGuire, Taylor; Wayne Miler, Gibraltar, all of Mich.

[73] Assignee: AJF, Inc., Plymouth, Mich.

[21] Appl. No.: 15,559

[22] Filed: Feb. 9, 1993

Related U.S. Application Data

[63] Continuation-in-part of Ser. No. 898,014, Jun. 12, 1992, Pat. No. 5,249,780.

[51] Int. Cl.[5] ..... B23D 41/14

[52] U.S. Cl. ..... 266/230; 266/227

[58] Field of Search ..... 266/227, 230, 277, 45

[56] References Cited

U.S. PATENT DOCUMENTS

| | | | |
|---|---|---|---|
| 11,676 | 9/1854 | Morris | 73/373 |
| 4,526,349 | 7/1985 | Schwer | 266/45 |
| 4,553,743 | 11/1985 | La Bate, II et al. | 266/272 |
| 4,601,415 | 7/1986 | Koffron | 266/227 |
| 4,610,436 | 9/1986 | La Bate, II et al. | 266/272 |
| 4,637,592 | 1/1987 | La Bate, II et al. | 266/272 |
| 4,640,498 | 2/1987 | La Bate, II et al. | 266/272 |
| 4,709,903 | 12/1987 | La Bate | 266/227 |
| 4,725,045 | 2/1988 | Cutre et al. | 266/230 |
| 4,871,148 | 10/1989 | Koffron | 266/230 |
| 4,922,994 | 5/1990 | Ogura et al. | 222/602 |
| 4,968,007 | 11/1990 | Forte et al. | 266/100 |
| 5,044,610 | 9/1991 | Koffron | 266/45 |

FOREIGN PATENT DOCUMENTS

| | | |
|---|---|---|
| 62-229697 | 9/1987 | Japan . |
| 64-75142 | 3/1989 | Japan . |

OTHER PUBLICATIONS

Bindicator Level Sensors, Apr., 1990.

Bindicator Yo-Yo Systems, Apr., 1990.

*Primary Examiner*—Scott Kastler

*Attorney, Agent, or Firm*—Basile and Hanlon

[57] ABSTRACT

A slag control shape is releasably mounted on a cover for a molten metal vessel. An actuator is connected to a slag control shape release member to retract the release member from a first position engaged with the slag control shape to a second position separated from the slag control shape allowing the slag control shape to freely drop into the molten metal receptacle. The actuating end of the actuator is located at an easily accessible operator position for remote actuation of the release member. In one embodiment, the actuator is a flexible cable attached at one end to the release member mounted on the cover and having a second end located remote from the cover at an easily accessible operator position. In another embodiment, one end of a cable wound in a plurality of turns about a rotatable shaft mounted in a reel is attached to the slag control shape. A spring biasingly engages the shaft to control the rate of rotation of the shaft and thereby the rate of payout of the cable and the rate of descent of the slag control shape into the molten metal vessel. A detector counts the revolutions of the shaft as the cable is paid out to measure the distance the slag control shape has descended into the vessel.

35 Claims, 7 Drawing Sheets

SLAG CONTROL SHAPE RELEASE APPARATUS FOR MOLTEN METAL VESSELS

CROSS REFERENCE TO CO-PENDING APPLICATIONS

The present invention is a continuation-in-part application of co-pending U.S. patent application Ser. No. 07/898,014, filed Jun. 12, 1992 now U.S. Pat. No. 5249780, in the names of Gary L. Forte, James P. McGuire and Wayne Miller for "SLAG CONTROL SHAPE RELEASE APPARATUS FOR MOLTEN METAL VESSELS."

BACKGROUND OF THE INVENTION

1. Field of the Invention

The present invention relates, in general, to metal making apparatus and, specifically, to molten metal receptacles and, more specifically, to slag control shapes used in molten metal vessels.

2. Description of the Art

In metal making processes, such as steel making, molten metal is transferred from a furnace or converter by a ladle to a tundish or directly to a casting machine. In all metal making processes, and, in particular, in steel making processes, a layer of slag containing metal impurities forms above the top surface of the molten metal within the ladle and the tundish. When the molten metal is discharged from the ladle or tundish, it is necessary to maintain a separation between the slag and the molten metal so that high quality steel without significant amounts of slag can be produced.

The slag forms a layer of impurities several inches thick on top of the layer of molten metal in the ladle and in the tundish. In addition, the flow of molten metal through the discharge nozzle in the ladle or tundish creates a vortex which introduces a conically-shaped rotation to the molten metal immediately above the discharge nozzle. When a sufficient quantity of molten metal is maintained within the ladle or tundish, the vortex forms completely within the molten metal layer and does not reach to the slag layer atop the molten metal layer. However, when the level of molten metal within the ladle or tundish drops below the predetermined critical depth, the vortex reaches into the slag layer and draws slag through the center of the vortex to the discharge nozzle along with molten metal. This causes the introduction of slag into the molten metal as it is discharged from the ladle or the tundish and results in steel having less than desirable quantities as well as creating a potentially hazardous situation.

In order to prevent the introduction of slag into the molten metal, various slag control shapes, such as balls, frusto-conical bodies, etc., as shown in U.S. Pat. Nos. 4,725,045 and 4,968,007, are introduced into the transfer ladle or tundish. Such slag control shapes or bodies have a predetermined specific gravity less than the specific gravity of the molten metal and greater than the specific gravity of the slag layer so that the slag control shape or body is buoyantly supported at the interface between the slag layer and the molten metal layer. Such slag control bodies or shapes are also designed to locate and center themselves automatically in the vortex formed above the discharge nozzle from the molten metal vessel or receptacle. The lower portion of such slag control bodies is disposed in the molten metal layer and will enter and seat within the upper portion of the discharge nozzle of the molten metal receptacle when the molten metal layer drops below a predetermined depth so as to block the discharge nozzle and prevent the discharge of slag from the receptacle.

While such slag control bodies or shapes have found widespread use and effectively block the undesirable discharge of slag from a molten metal vessel, such as a transfer ladle or tundish, the introduction of such slag control bodies into the molten metal receptacle has proved to be a problem.

Typically, such slag control bodies are introduced into the transfer ladle or tundish at a predetermined time during the discharge of molten metal from the ladle or tundish. The time of insertion of the slag control body is based on an operator's experience, based on the total time of molten metal discharge, or on a potentially inaccurate scale reading. As ladles positioned in caster turret arms are typically 20 feet or more in height, overhead cranes have been used to drop the slag control body into the ladle at the point in time indicated by an operator. However, such cranes are assigned numerous other tasks which make it difficult to insure that a crane is available at the precise time that the operator determines it necessary to insert the slag control body into the molten metal vessel.

A small number of metal making or casting machine installations have a stairway located adjacent the discharge position of a ladle which enables a worker, such as a ladleman, to climb to the top of the ladle and insert the slag control body into the ladle at the required time. However, the height of the ladle, the approximate 25 pounds or more weight of the slag control body, and the high temperatures involved in the molten metal process make such a task difficult, undesirable and dangerous. Further, the ladleman typically has other duties in monitoring the metal making process which must be neglected for the time it takes to climb the stairs and insert the slag control body. Dedicating one person solely to the task of inserting the slag control body into the molten metal vessel at the required time adds costs to the metal making process as such an individual is only required is to perform his single task at widely spaced, intermittent intervals.

Further, when such slag control shapes are dropped into a molten metal vessel, they typically fall from 10 to 15 feet before hitting the slag layer. Due to the buoyancy characteristics of a slag control shape and its momentum during dropping into the vessel, the slag control shape will initially pass through the slag layer and into the molten metal and then bob up out of the molten metal and slag until it settles at the molten metal/slag interface. However, this bobbing force and the inherent buoyancy characteristics of a slag control shape frequently cause the slag control shape to settle at a position away from a desired position directed above the discharge outlet of the molten metal vessel. Indeed, it is infrequent for the slag control shape to settle directly over the discharge outlet since the discharge outlet is typically 2 ½ to 4 ½ inches in diameter as compared to the 10 to 20 foot diameter of a typical ladle. Thus, when a vortex begins to form above the discharge outlet when the molten metal reaches a low level within the ladle or vessel, the slag control shape may not be able to reach the vortex in time to serve its function of blocking the outlet to prevent the discharge of slag through the outlet. Furthermore, even if the slag control shape initially settles directly over the discharge outlet, it frequently drifts away since a vortex may not have formed above the outlet and never returns to the desired centered position thereby defeating its intended purpose.

Thus, it would be desirable to provide an apparatus which simplifies the task of inserting a slag control shape or body into a molten metal vessel. It would also be desirable to provide an apparatus for inserting a slag control body into a molten metal vessel which may be actuated at an easily accessible position remote from the point of insertion of the slag control body into the molten metal vessel. It would also be desirable to provide an apparatus for inserting a slag control shape or body into a molten metal vessel which ensures that the slag control shape remains centered directly over the discharge outlet of the molten metal vessel.

SUMMARY OF THE INVENTION

The present invention is a slag control shape release apparatus for a molten metal receptacle having an open top end, side and bottom walls, an interior cavity containing a layer of slag covering a layer of molten metal, a discharge nozzle formed in the bottom wall, a cover removably closing the open top end of the receptacle and having an aperture extending therethrough, and a slag control shape insertable into the receptacle and buoyantly supported at the interface between the layer of slag and the layer of molten metal, the slag control shape release apparatus includes means, mounted on the cover, for releasably mounting the slag control shape on the cover and means, connected to the mounting means, for actuating the mounting means to release the slag control shape from the cover into the molten metal receptacle, the actuating means being operable from a location remote from the cover when the cover is mounted on the molten metal receptacle.

In one embodiment, the mounting means comprises an aperture formed in the cover through which a hanger mounted on and extending outward from the slag control shape extends. A pin is slidably mounted on the cover and is biased to a first, extended position in which the pin engages the hanger to support the slag control shape on the cover.

The actuating means, in one embodiment, comprises a flexible cable having a first end connected to the mounting means or pin. The cable has a second end located remote from the pin at an easily accessible position for retraction of the mounting means or pin from the first position to the second retracted position. The second end of the cable is located at a remote location from the cover in an easily accessible position for an operator attending to the molten metal process utilizing the molten metal receptacle.

In another embodiment, the actuating means comprises first and second eccentric cams mounted on the cover and the molten metal receptacle, respectively. A first cable is fixedly connected at one end to the first cam and to the mounting means or pin at another end. A second cable is fixedly connected to the second cam at one end and has a second end located at a position remote from the second cam. The first and second cams are disposed in close proximity when the cover is mounted on the molten metal receptacle such that movement of the second cable causes rotation of the second cam into engagement with and simultaneous rotation of the first cam to move the first cable in a direction to retract the mounting means or pin to the second, retracted position to release the pin from engagement with the slag control shape and enabling the slag control shape to drop into the interior of the molten metal receptacle.

In yet another embodiment, means are attached to the slag control shape for controlling the rate of descent of the slag control shape into the molten metal vessel after the slag control shape has been released from the mounting means. The means for controlling the rate of descent of the slag control shape includes a rotatable shaft mounted on a reel affixed to the slag control shape mounting means. A flexible cable is wound in a plurality of turns about the shaft and is attached at one end to the slag control shape. Means are provided for maintaining the rate of rotation of the shaft constant after release of the slag control shape from the mounting means to thereby control the rate of descent of the slag control shape into the molten metal vessel until the slag control shape reaches and settles at the molten metal/slag interface in the vessel.

The constant rotation maintaining means preferably comprises a plate movably disposed with respect to the shaft. A biasing means urges the plate into engagement with the shaft under a predetermined frictional force to provide a constant rate of rotation of the shaft and payout of the cable from the shaft to control the rate of descent of the slag control shape into the molten metal vessel.

This latter embodiment is ideally suited to provide a specific indication of the depth of the molten metal/slag interface or the height of molten metal remaining in the vessel. A detector is mounted on the reel to detect the number of revolutions of the shaft. The shaft may be provided with spirally shaped grooves, each receiving one turn of the cable, such that the cable is wound in a plurality of turns, each turn having the same diameter along the length of the shaft. In this manner, the number of rotations of the shaft may be used to calculate the length of cable paid out and thereby the distance the slag control shape has descended into the vessel by means of a counter connected to the detector. This provides an indication, based on the known height of the molten metal vessel, of the height of molten metal remaining in the vessel after the slag control shape has settled at the molten metal/slag interface.

The slag control shape release apparatus of the present invention overcomes certain problems associated with the use of such slag control shapes in molten metal receptacles, such as ladles or tundishes. The release apparatus of the present invention enables the slag control shape to be automatically dropped at the proper time, as determined by a ladleman, into the interior of the molten metal receptacle wherein the slag control shape is buoyantly supported at the slag/molten metal interface directly above the discharge nozzle to prevent the discharge of slag from the molten metal receptacle when the layer of molten metal reaches a critical, low level within the molten metal receptacle. The same operator or ladleman attending to the molten metal process utilizing the molten metal receptacle can thusly control the release of the slag control shape at the proper time without leaving his normal work station or neglecting his other duties.

The slag control shape release apparatus of the present invention also eliminates the need for overhead cranes to drop slag control shapes into molten metal receptacles as well as the use of an individual specifically assigned the task of inserting the slag control shape into the molten metal receptacle at the proper time.

The slag control shape release apparatus of the present invention is of simple and inexpensive construction and can be easily mounted on existing molten metal receptacle covers without extensive modification of such covers or molten metal receptacles.

The slag control shape of the present invention also ensures that the slag control shape remains centered directly above the discharge outlet of a molten metal vessel. This enables the slag control shape to consistently and repeatedly perform its intended purpose of blocking the discharge outlet when the molten metal/-slag interface reaches a predetermined low level to prevent the discharge of slag through the outlet in the vessel.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

The present invention is a slag control shape or body release apparatus which inserts a slag control shape into a molten metal vessel, such as a transfer ladle or tundish, at an appropriate time determined by an operator or ladleman.

Figure 1:
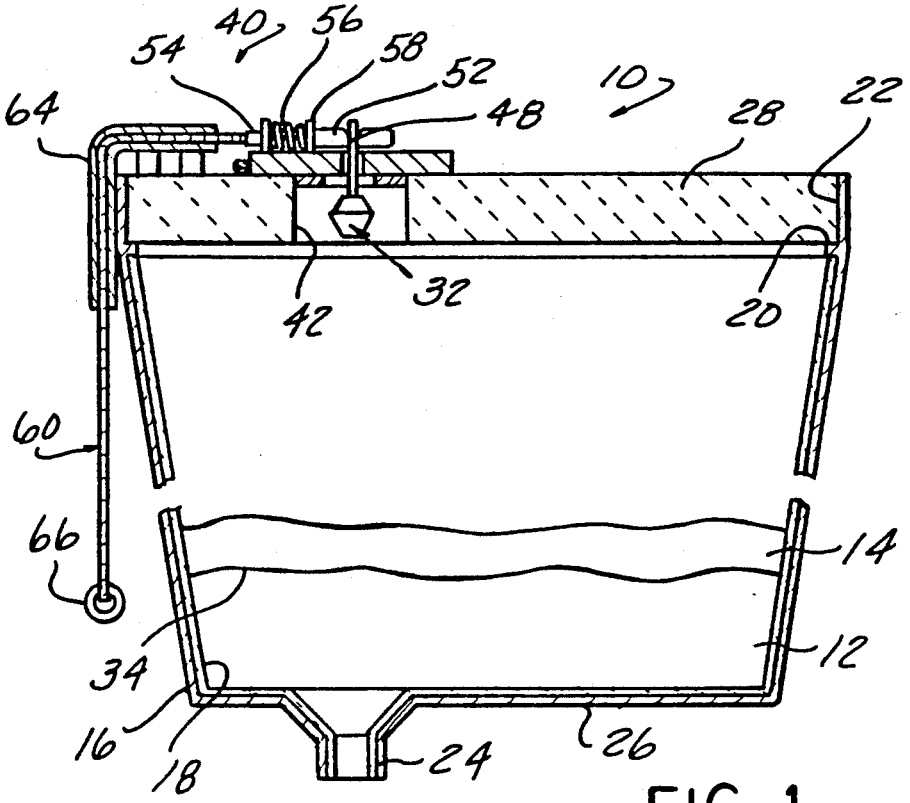
FIG. 1 is a cross-sectioned, side view of a slag control shape release apparatus of the present invention mounted on a transfer ladle.

As shown in FIG. 1, a molten metal receptacle 10 is provided for containing a layer of molten metal 12, such as steel, etc. As is conventional, a layer of slag 14 forms on the top of the layer of molten metal 12 within the vessel 10. Although the molten metal vessel 10 is illustrated as being in the form of a transfer ladle used to transfer molten metal from a tapping converter or furnace to a tundish or casting machine, it will be understood that the slag control release apparatus of the present invention may also be employed with other types of molten metal vessels, such as tundishes, etc.

By way of background, the molten metal vessel or ladle 10 includes outer, generally conical side walls formed of a metallic outer shell 16 and an inner layer 18 formed of a refractory material, such as firebrick, etc. A shoulder denoted by reference number 20 is formed adjacent an open top end 22 of the ladle 10. A discharge nozzle or outlet 24 is formed in a bottom wall 26 of the ladle 10 and provides an outlet path for molten metal from the ladle 10 to a tundish, casting machine, etc.

Figure 3:
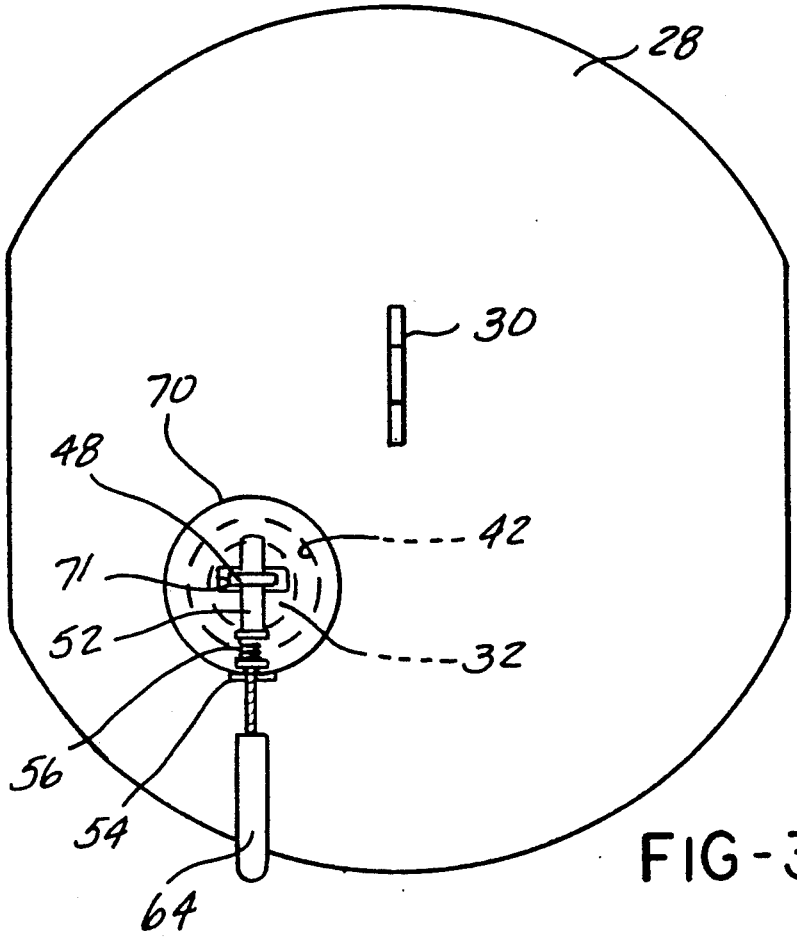
FIG. 3 is a plan view of the slag control shape release apparatus and transfer ladle cover shown in FIG. 1.

Although not required or always used, a cover 28 having a generally circular shape with two opposed straight sides, as shown in FIG. 3, is formed of a refractory material and is removably inserted into the shoulder 20 in the open top end 22 of the ladle 10 to close off the interior of the ladle 10 in order to retain heat within the molten metal 12 in the ladle 10. The cover 28 is mounted on and removed from the ladle 10 by means of a crane which engages a hook 30 mounted on the cover 10.

As is conventional, a slag control shape or body denoted generally by reference number 32, is employed to prevent the discharge of slag 14 through the discharge nozzle 24 when the layer 12 of molten metal reaches a predetermined low depth. The slag control shape or body 32 may have any predetermined size and shape, such as that disclosed in Applicant's own U.S. pat. No. 4,968,007 or the plug shown in U.S. Pat. No. 4,725,045. The contents of U.S. Pat. No. 4,968,007, with regard to the description and use of the slag control body, is incorporated herein by reference. Generally, however, such slag control shapes or bodies 32 are formed of a suitable refractory material having a specific gravity less than the specific gravity of the molten metal 12, but higher than the specific gravity of the slag 14. In this manner, the slag control shape or body 32 buoyantly floats at the interface 34 formed between the layer of molten metal 12 and the slag layer 14. When the layer of molten metal 12 reaches a predetermined low level, the lower portion of slag control body 32 will first prevent the vortex action from occurring and as draining is completed, will engage the discharge nozzle 24 in the ladle 10 and thereby block the further discharge of molten metal and, more importantly, the discharge of slag 14 from the ladle 10.

According to the present invention, a slag control shape release apparatus 40 is provided for inserting the slag control shape or body 32 into the ladle 10 at the appropriate time determined by an operator monitoring the metal making process utilizing the ladle 10. The apparatus 40 includes a means for releasably mounting the slag control shape or body 32 on the cover 28 and, means, connected to the mounting means, for actuating the mounting means to release the slag control shape 32 from the cover 28, the actuating means being operable and accessible to the operator at a location remote from the cover 28. In a preferred embodiment, a bore 42 is formed in the cover 28 generally centered over the discharge nozzle 24. Suitable locating means, not shown, will also be formed on the cover 28 to insure that the cover 28 is inserted in the proper position on the ladle 10 to position the bore 42 in the cover 28 substantially over the discharge nozzle 24 of the ladle 10. An upper end 44 of the bore 42 is closed off by means of an extension of the cover 28 or by separate high temperature insulation which is attached to the cover 28. A smaller aperture 46 is formed in the extension 44 and receives a hanger 48 integrally formed with and extending outward from one end of the slag control shape 32. The hanger 48 has a central aperture 50 extending therethrough for receiving a slidable pin 52. The pin 52 is part of the slag control shape mounting means and is slidably supported on the top surface of a lid 70.

Figure 2:
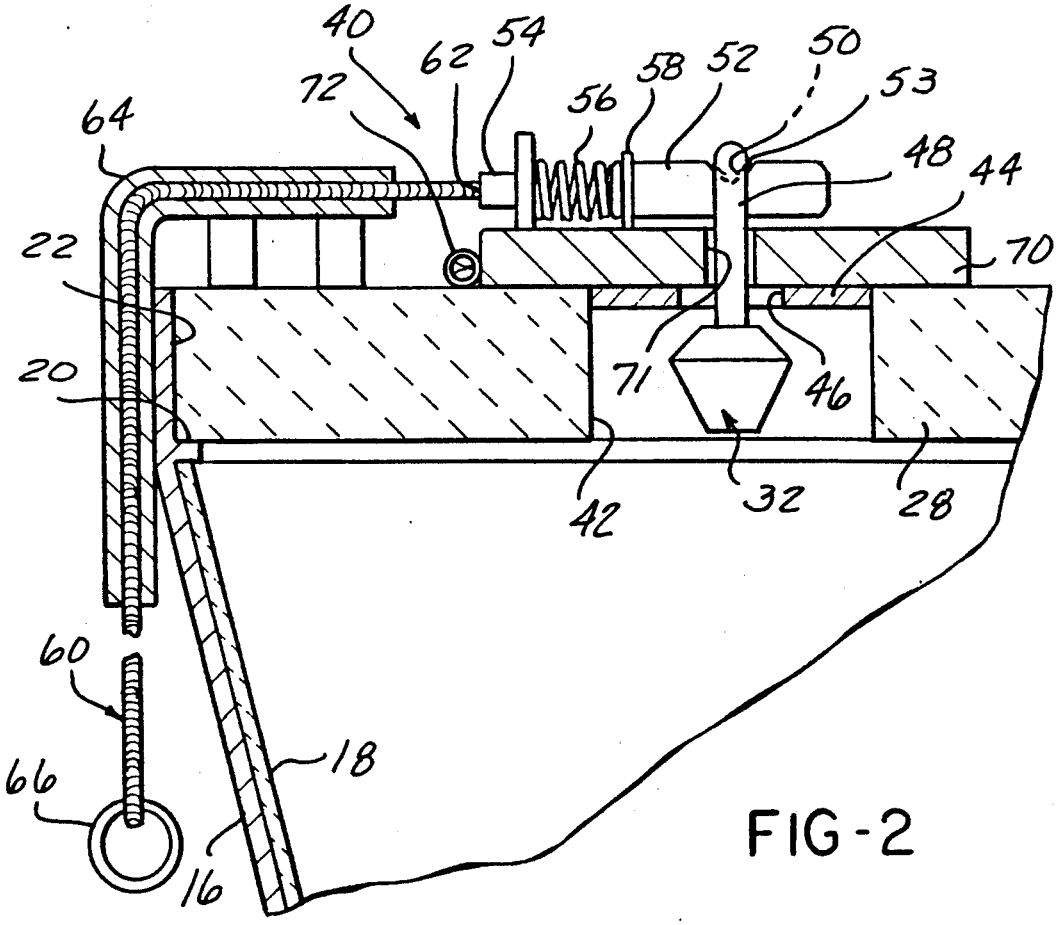
FIG. 2 is a partial, enlarged view of the slag control shape release apparatus shown in FIG. 1.

As shown in FIGS. 1-3, the lid 70 is pivotally mounted on the top surface of the cover 28 by means of a suitable hinge 72. The lid 70 covers the upper opening of the bore 42 in the cover 28 to retain heat within the ladle 10 when the cover 28 is mounted on the ladle 10. The slot 71 is formed in the lid 70 to receive the hanger 48 of the slag control shape 32 therethrough as described above.

The pin 52 includes a notch 53 which engages and supports the slag control shape hanger 48 when the pin 52 is in a first extended position shown in FIGS. 1 and 2.

The mounting means also includes a stop bracket 54 which is attached to the top surface of the lid 70 and has a bore extending therethrough. A biasing means, such as a coil spring 56, engages the stop bracket 54 at one end and one end 58 of the pin 52 at another end. The biasing means 56 normally biases the pin 52 to the first, extended position shown in FIGS. 1 and 2. However, the biasing force of the biasing spring 56 is overcome, as described hereafter, by a force exerted on an actuating means which moves the pin 52 to a second position separated from the hanger 48 on the slag control shape 32 and allows the slag control shape 32 to freely drop into the interior of the ladle 10 for normal functioning of the slag control shape 32.

Figure 4:
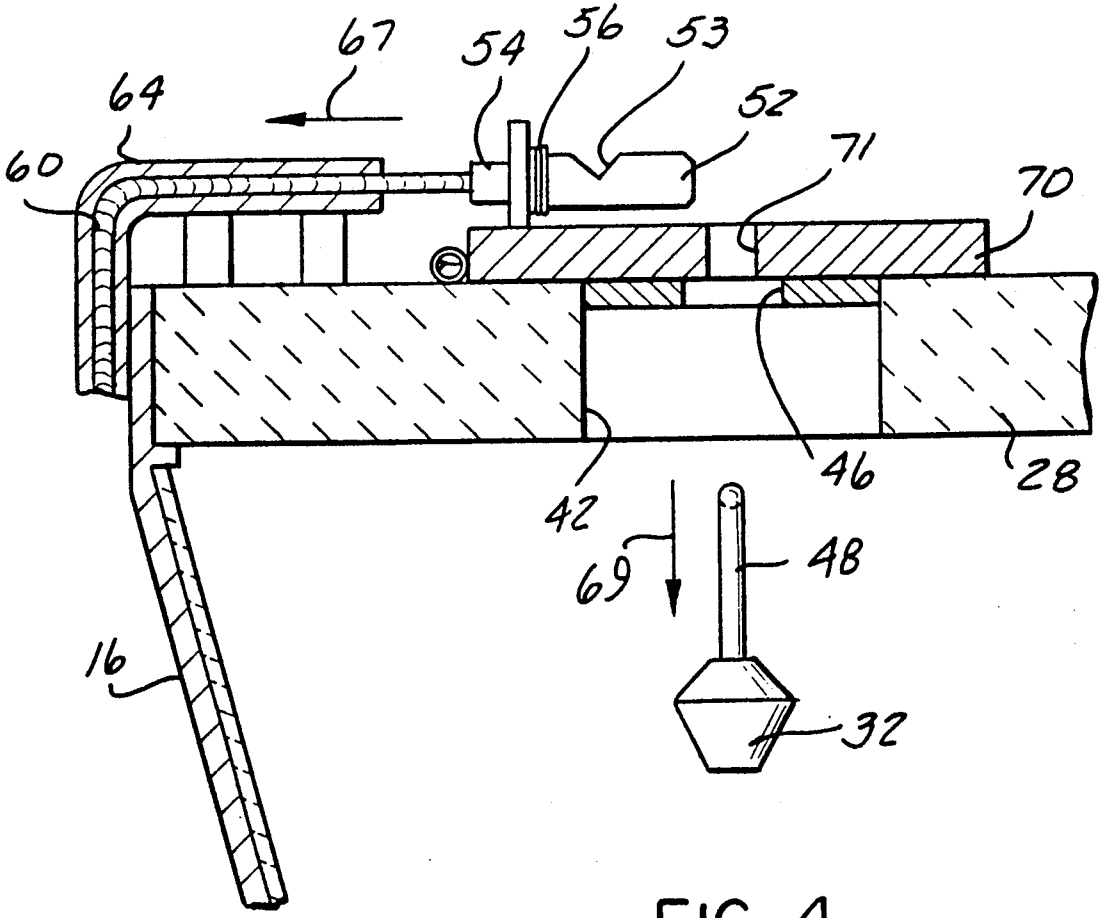
FIG. 4 is a partial, enlarging view similar to FIG. 2, but shown in the pin in its second, retracted position.

In a preferred embodiment, the actuating means comprises a flexible cable, such as a steel cable 60. A first end 62 of the cable 60 extends through the bore int he stop bracket 54 and is fixedly connected to the pin 52. The cable 60 is surrounded by the biasing spring 56 as shown in FIG. 2. Further, a cable sleeve 64 in the form of a hollow, steel conduit is attached to the upper edge of the cover 28 and extends downward below the cover 28 and an adjoining portion of the side wall 16 of the ladle 10 when the cover 28 is mounted on the top end 22 of the ladle 10 to protect a portion of the cable 60. A second end 66 of the actuating cable 60 is located at a position remote from the cover 28 when the cover 28 is mounted on the top end 22 of the ladle 10. Preferably, the second end 66 of the cable 60 is located at an easily accessible position for an operator, such as a ladleman, typically situated near the bottom of the ladle 10. The ladleman can pull downward on the second end 66 of the cable 60 to retract the pin 52 from the first position shown in FIG. 2 in the direction of the arrow 67 in FIG. 4 to the second, retracted position shown in FIG. 4 thereby pulling the pin 52 from the hanger 48 on the slag control shape 32 and allowing the slag control shape 32 to freely drop into the interior of the ladle 10, arrow 69 in FIG. 4, wherein it will buoyantly float at the slag/molten metal interface 16 in the ladle 10.

It will also be understood that the second end 66 of the cable 60 may be located at any other convenient position with respect to the ladle 10. For example, the cable 60 may be wrapped around the outer surface of the ladle 10 by means of a suitably shaped cable sleeve, similar to cable sleeve 64, to the right-hand side of the ladle 10 in the orientation shown in FIG. 1. Further, instead of using manual force to actuate the cable 60, various power drive means, such as fluid cylinders, etc., may be connected to the cable 60 for driving the second end 66 of the cable 60 in a direction to retract the pin 52 from the hanger 48 on the slag control shape 32 as described above.

Figure 5:
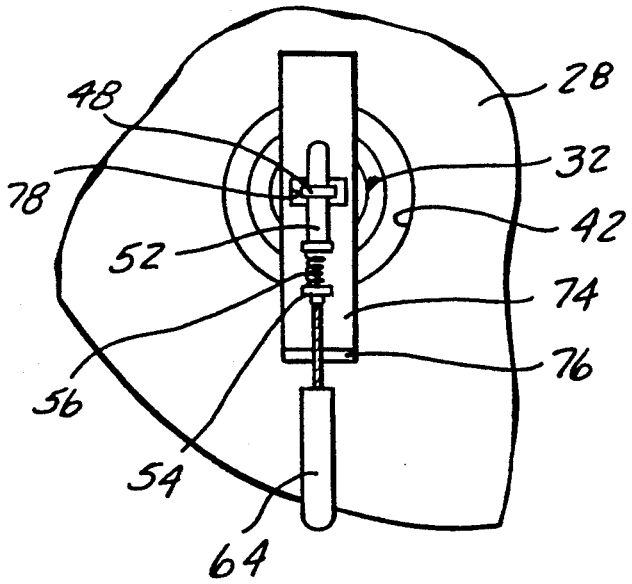
FIG. 5 is a partial, plan view showing another embodiment of the slag control shape release apparatus of the present invention.

In another embodiment shown in FIG. 5, a narrow, strip-like bar 74 is mounted on the cover 28 by means of a hinge 76 and extends over the open end of the bore 42 in the cover 28. The stop bracket 54 is mounted on the bar 74 as well as the movable pin 52. A slot 78 is formed in the bar 74 for receiving the slag control shape 32 hanger 48 therethrough in the same manner as described above to enable the pin 52 to engage the hanger 48 and thereby mount the slag control shape 32 in the cover 28 prior to its release as described above by means of actuation of the cable 60. The bar 74 is pivotal away from the cover 28 to enable the slag control shape 32 to be inserted in the bore 42 in the cover 28.

In a normal sequence of operation, the cover 28 will be situated on the floor during emptying of the ladle 10 from a previous heat or load of molten metal and slag. At this time, the hinged lid 70 or bar 74 may be pivoted upward to enable the insertion of the slag control shape 32 into the bore 42 in the cover 28. The cover 70 or bar 72 is then lowered into engagement with the cover 28 with the hanger 48 of the slag control shape 32 extending outward through the slot 71 in the lid 70 or the slot 78 in the bar 74.

During this slag control body 32 mounting operation, the pin 52 is held in the second, retracted position against the force of the biasing spring 52. When the hanger 48 has been extended through the aperture 71 in the lid 70 or the aperture 76 in the bar 74, the pin 52 is released to bring the notch 54 in the pin 52 in supporting engagement with the hanger 48 to releasably mount the slag control body 32 in the bore 42 in the cover 28. The cover 28 may then be raised by means of a crane into position covering the open top end 22 of the ladle 10 after a new heat or shot of molten metal has been poured into the ladle 10.

Figure 6:
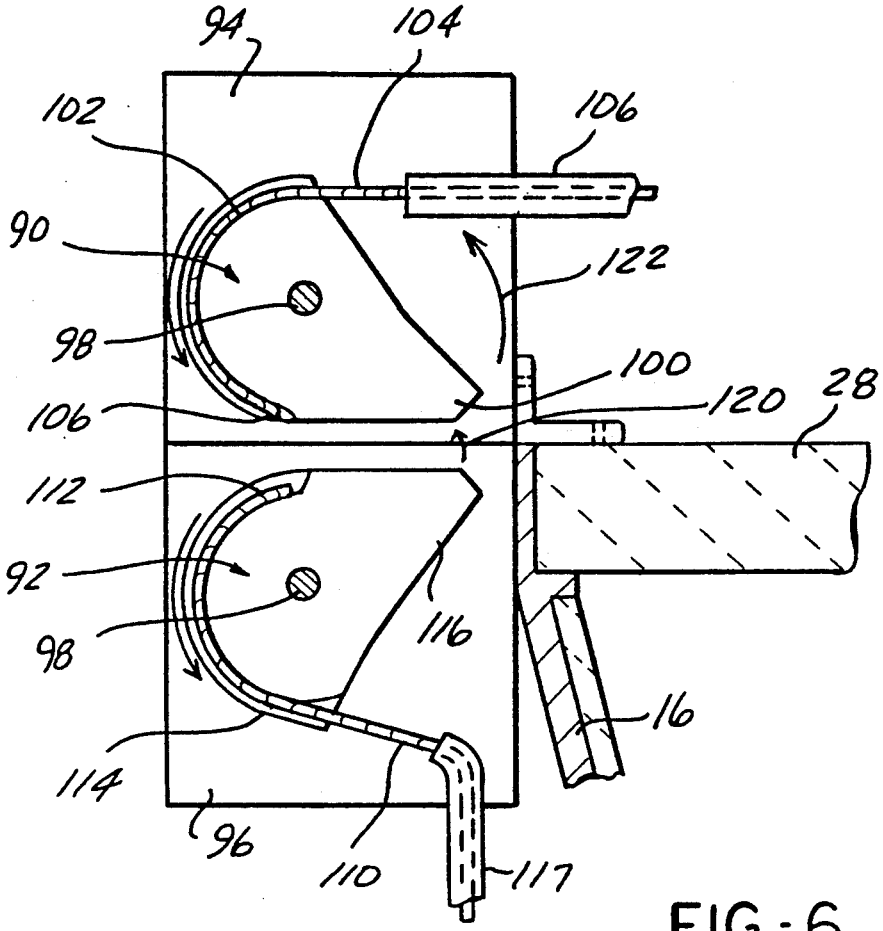
FIG. 6 is a side elevational view of another embodiment of a slag control shape release apparatus of the present invention.
Figure 7:
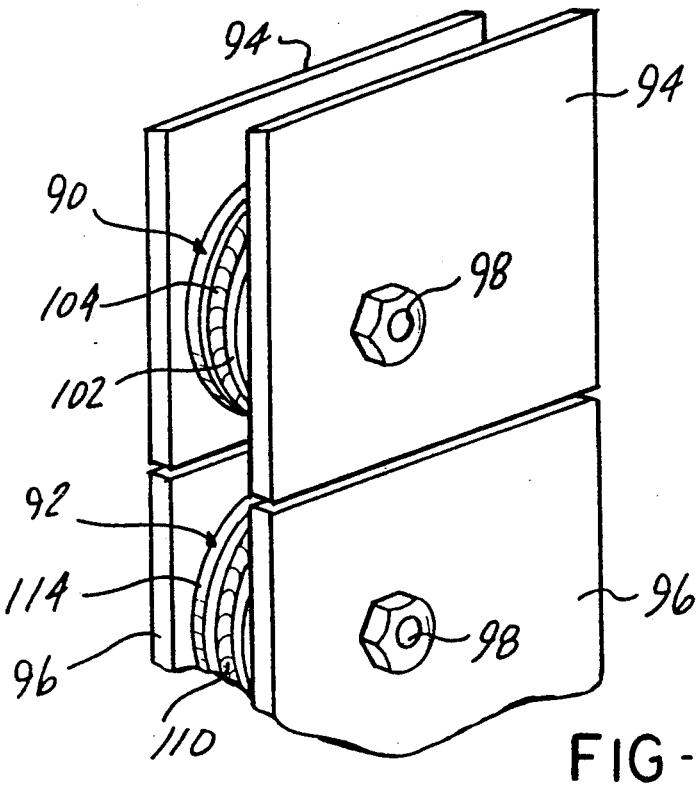
FIG. 7 is a partial, perspective view of the slag control shape release apparatus shown in FIG. 6.

Referring now to FIGS. 6 and 7, there is depicted another embodiment of a means for actuating the pin 52 to release the slag control shape 32 from the cover 28 so as to insert the slag control shape 32 into the ladle 10. In this embodiment, the pin 52, stop bracket 54, biasing spring 56 and stop plate 58 are the same as that described above and shown in FIGS. 1-3 and have not been shown in FIGS. 6 and 7.

The actuating means, in this embodiment, includes first and second eccentric cams 90 and 92, respectively. The first cam 90 is pivotally mounted between a pair of spaced plates, both denoted by reference number 94, which are fixedly attached by suitable means to one edge of the cover 28. A similar pair of plates denoted by reference number 96 are mounted to an upper edge of the side wall 16 of the ladle 10 and pivotally support the second cam 92 therebetween by means of a pivot connection 98 extending through the plates 96 and the second cam 92. A similar pivot pin 98 is used to pivotally mount the first cam 90 between the spaced plates 94.

As shown in FIGS. 6 and 7, the pairs of spaced plates 94 and 96 are disposed in substantial registry when the cover 28 is mounted on the top end 22 of the ladle 10.

The first cam 90 has an elongated leg portion 100 extending from the pivot pin 98. An opposed, generally arcuate-shaped end portion 102 is also formed on the first cam 90. A first cable 104 is fixedly connected at an end 106 to the arcuate section 102 of the first cam 90 and moves with rotation of the first cam 90 as described hereafter. The first cable 104 passes through a cable sleeve 106 mounted to and extending outward from the plates 94 through the stop bracket 54, described above, to a connection with the pin 52.

Similarly, a second cable 110 is fixedly connected at one end 112 to an arcuate end portion 114 formed on the second cam 92. The opposite end of the second cam 92 is formed as an elongated leg 116 as shown in FIG. 6. The second cable 110 passes through a cable sleeve 117 mounted to the spaced plates 96 and downward to its remote second end, not shown.

The legs 100 and 116 of the first and second cams 90 and 92, respectively, are disposed in normal spaced, close proximity as shown in FIG. 6. Downward force on the second cable 110, such as a downward force exerted by the ladleman on the second end of the second cable 110 will cause the second cam 92 to pivot about the pivot pin 98 and thereby move the leg 116 in the direction of arrow 120 into engagement with the leg 100 of the first cam thereby causing rotation of the first cam 90 in the direction of arrow 122. This rotation of the first cam 90 in the direction of arrow 122 exerts a force on the first cable 104 pulling the cable 104 to the left in the orientation shown in FIG. 6. This results in a retraction of the pin 52 from the hanger 48 on the slag control body 32 thereby releasing the slag control body 32 from its mounting position in the cover 28 of the ladle 10. A discontinuance of the downward force on the second cable 110 causes the second cam 92 to return to its normal position shown in FIG. 6. The biasing force exerted by the spring 56 on the pin 52 will simultaneously cause the first cam 90 to return to its normal position shown in FIG. 6.

Referring now to FIGS. 8–14, there is depicted another embodiment of the present invention in which the slag control shape release apparatus includes means for controlling the descent of the slag control shape into the molten metal vessel.

Figure 8:
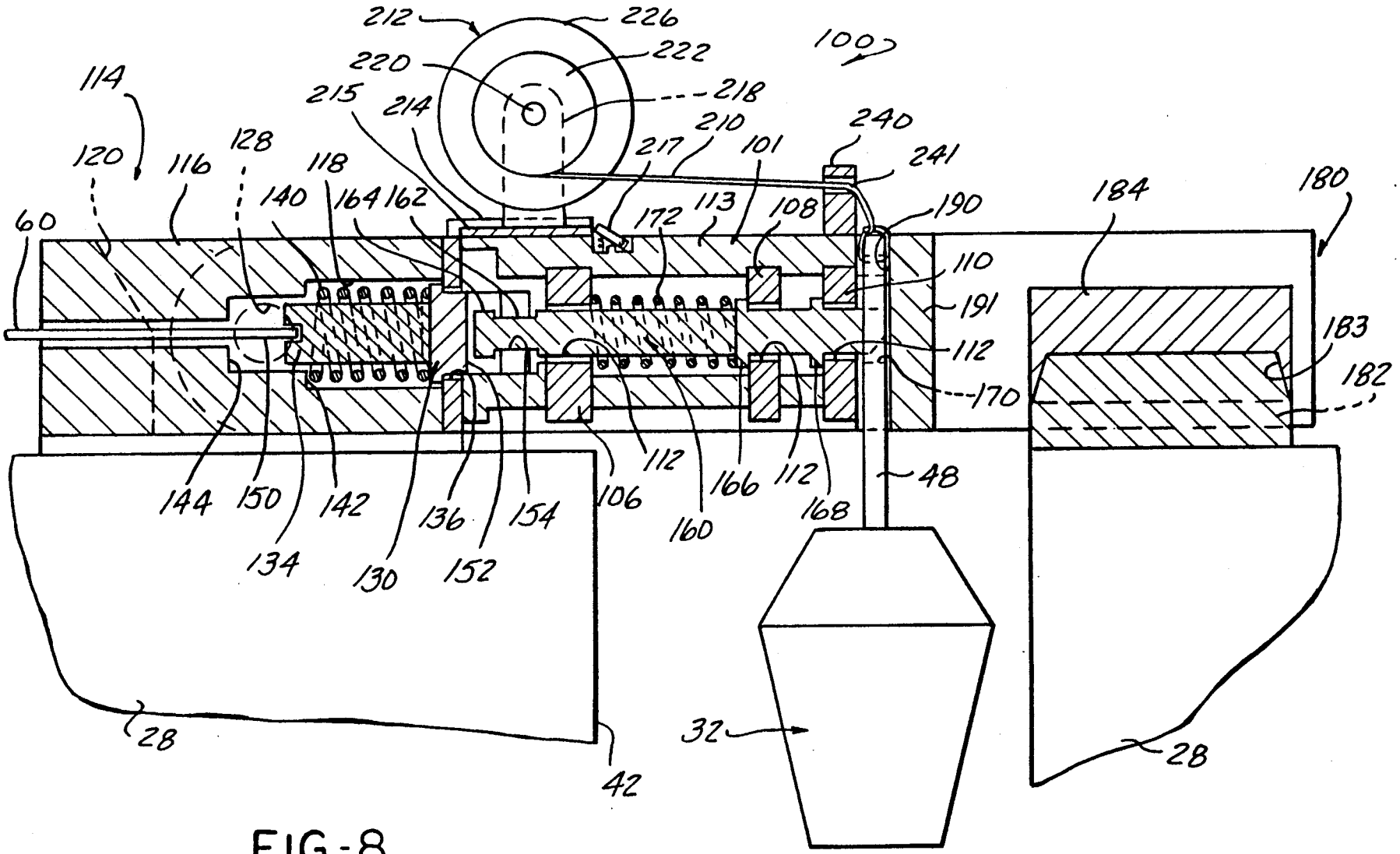
FIG. 8 is a longitudinal cross-section of another embodiment of the apparatus of the present invention.
Figure 9:
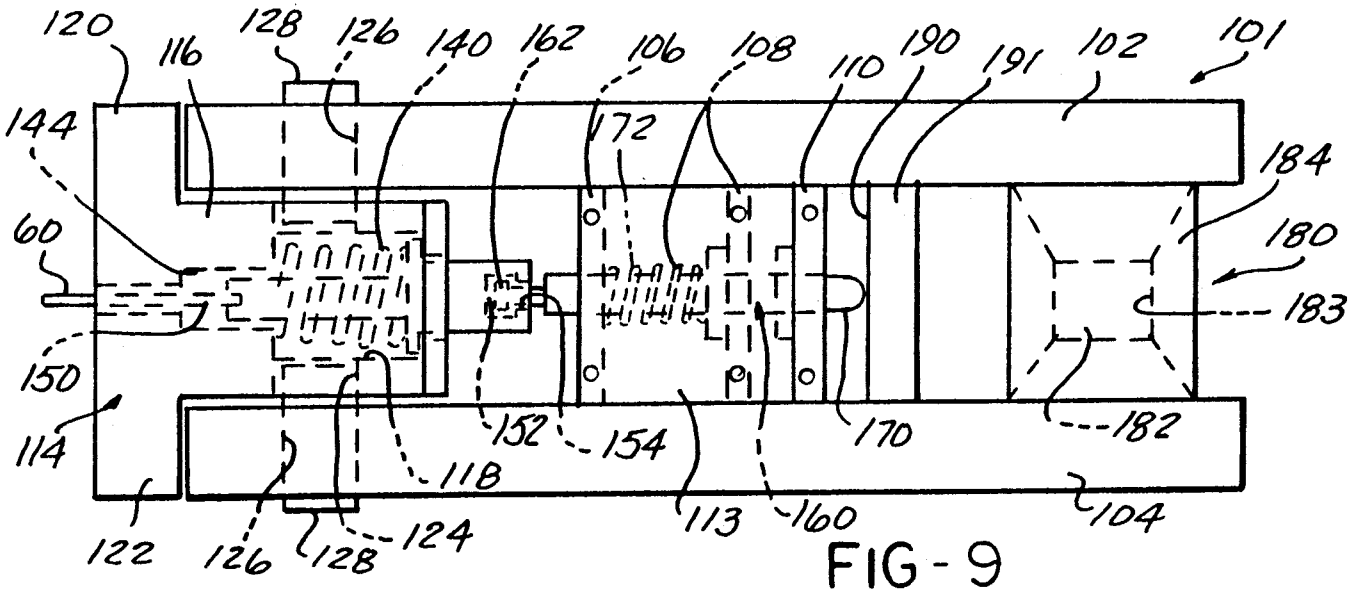
FIG. 9 is a complete plan view of the embodiment shown in FIG. 8.

As shown in FIGS. 8 and 9, a slag control shape 32 having a hanger or rod 48 extending from one end is supported in an aperture 42 in the cover 28 of a molten metal vessel, such as a transfer ladle or tundish, by a releasable mounting means denoted generally by reference number 100. As described above, the aperture or bore 42 is located in the cover 28 directly over the well or tap hole 24 on the vessel 10.

The releasable mounting means 100 includes an arm assembly 101 formed of two spaced arms 102 and 104 which are joined together in a rigid assembly by means of a plurality of interconnecting plates or ribs 106, 108 and 110. Each of the plates 106, 108 and 110 are joined to the arms 102 and 104 by suitable means, such as by welding, or by the use of separate fasteners, not shown. Each of the plates 106, 108 and 110 also includes a central bore 112. The bores 112 are co-axially aligned through all of the plates 106, 108 and 110. A cover plate 113 is fastened to the plates 106, 108 and 110.

Figure 13:
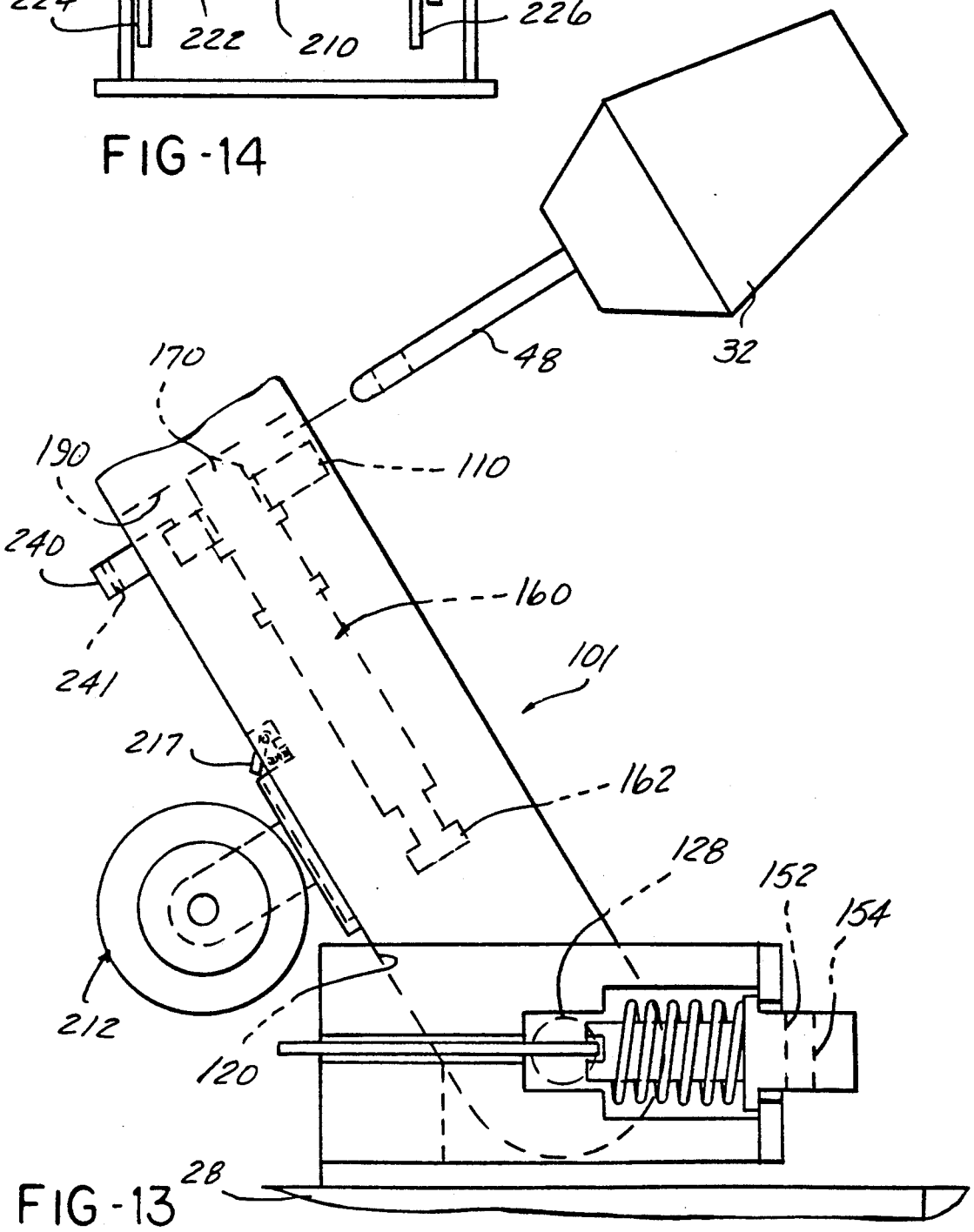
FIG. 13 is a side elevational view showing a pivoted position of the apparatus depicted in FIG. 8.

The arm assembly 101 is pivotally connected to a yoke 114 for pivotal movement from a first position shown in FIG. 8 in which the arm assembly 101 extends substantially horizontally over the top of the cover 28 to a pivoted, angular position shown in FIG. 13. The yoke 114 is formed with a central portion 116 having an internal bore 118 extending inward from one end. The other end of the yoke 114 terminates in a pair of outwardly extending flanges 120 and 122. The yoke 114 is fixedly mounted on the top of the cover 28, adjacent the bore 42 in the cover 28, by suitable means, such as by fasteners, welding, etc., not shown. A transverse bore 124 is formed in the central portion 116 of the yoke 114 and is co-axially aligned with bores 126 formed in one end of each of the arms 102 and 104 of the arm assembly 101. Pivot pins 128 are inserted through the bores 126 in the arms 102 and 104 and into the transverse bore 124 in the yoke 114 to pivotally connect the arm assembly 101 to the yoke 114. Suitable retainers, such as C clips, not shown, may be employed to retain the arms 102 and 104 on the pivot pins 128.

A latch alignment means 180 is mounted on the cover 28 for releasably latching the arm assembly 101 in a horizontal position on the cover 28. The latch alignment means 180 includes a frusto-conical locator 182 which is fixedly mounted to the cover 28. The locator 182 engages an inverted frusto-conical recess 183 formed in a receiver 184, mounted between the arms 102 and 104 of the arm assembly 101, to releasably latch and align the arm assembly 101 in the horizontal position shown in FIGS. 8 and 9. However, the latch alignment means 180 may be disengaged by exerting an upward force on the right most end of the arm assembly 101 to separate the receiver 184 from the locator 182 and to enable the entire arm assembly 101 to be pivoted upward away from the cover 28 as shown in FIG. 13 and described hereafter.

As shown in FIGS. 8 and 9, an actuating means for releasing the slag control shape from the arm assembly 101 includes a plunger 130 which is slidably mounted in the central portion 116 of the yoke 114. The plunger 130 has a first end 132 and an opposed second end 134. The first end 132 slidably extends through an aperture 136 formed in one end wall of the central portion 116 of the yoke 114. An enlarged shoulder 138 is formed on the plunger 130 intermediately between the first and second ends 132 and 134 and engages the edges of the end wall of the central portion 116 of the yoke 114 to limit the outward extension of the first end 132 of the plunger 130 from the yoke 114.

A biasing means 140, such as a coil spring, is disposed about the second end portion 134 of the plunger 130 within the bore 118 in the yoke 114. One end of the biasing means 140 seats against one surface of the shoulder 138 on the plunger 130. The opposite end of the biasing means or spring 140 seats against a shoulder 142 formed between one end of the bore 118 and a smaller diameter bore 144 extending co-axially therefrom within the yoke 114. The biasing means 140 normally biases the plunger 130 in a manner in which the first end 132 of the plunger 130 extends outward from the yoke 114.

The actuating means also includes a flexible cable denoted by reference number 60. The flexible cable 60 is the same as described above and shown in FIGS. 1 and 2. The cable 60 extends through a cable sleeve 64, not shown in FIGS. 8 and 9, which is mounted on the cover 28 in the same manner as shown in FIGS. 1 and 2. One end of the cable 60 is located at an easily accessible position for an operator, such as a ladleman, typically situated near the bottom of the ladle 10 on which the cover 28 is mounted, as described above and shown in FIGS. 1 and 2. The cable 60 may extend down the side of the vessel for a predetermined distance and terminate in a ring, not shown. The ladleman can use a hook to grasp the ring and exert a downward force on the cable 60.

The opposite end 150 of the cable 60 is fixedly attached to the second end 134 of the plunger 130. In this manner, a downward force exerted on the outermost, lower end of the cable 60 causes the plunger 130 to retract into the central portion 116 of the yoke 114 and pulls the first end 132 of the plunger 130 toward the end wall of the central portion 116 of the yoke 114.

As shown in FIGS. 8 and 9, a recess 152 is formed in and extends completely through the first end 132 of the plunger 130. The recess 132 communicates with a narrow slot 154 formed in the outer wall of the first end 132 of the plunger 130.

The releasable mounting means 100 also includes a pin 160 slidably mounted in the bores 112 in the plates 106, 108 and 110 in the arm assembly 101. The pin 160 has a first end 162 with an enlarged end portion 164. The first end portion 164 of the pin 160 is adapted to releasingly engage the recess 152 and the slot 154 in the first end 132 of the plunger 130 so as to join the pin 160 to the plunger 130 such that retraction of the plunger 130, as described above, causes a simultaneous movement of the pin 160 to the left in the orientation shown in FIGS. 8 and 9. At the same time, the first end 162 of the pin 160 is pivotally releasable from the recess 152 in the plunger 130 as described hereafter.

First and second enlarged shoulders 166 and 168 are spaced along the length of the pin 160 and are preferably located in a spaced manner from a second end 170 of the pin 160. The shoulder 166 on the pin 160, which is formed as an enlarged annular flange on the pin 160 intermediate the first and second ends 162 and 170 of the pin 160, is adapted to seat against the plate 108 when the pin 160 is in its normal, extended position, as shown in FIGS. 8 and 9. A biasing means, such as a coil spring 172, is disposed about the central portion of the pin 160 and seats at opposite ends against the plates 106 and 108. The biasing means or spring 172 functions to normally bias the pin 160 to the right in the orientation shown in FIGS. 8 and 9 by exerting force on the shoulder 166 of the pin 160.

The shoulder 168, which is also formed as an enlarged, annular flange on the pin 160, seats against the plate 110 in the arm assembly 101 when the pin 160 is in its normal, extended position, as shown in FIGS. 8 and 9. The shoulders 166 and 168 thus cooperate with the plates 108 and 110 to limit the sliding movement of the pin 160 to the right in the orientation shown in FIGS. 8 and 9. Upon retraction of the pin 160 to the left, as described hereafter, the shoulder 168 will engage the plate 108 to limit the amount of retraction of the pin 160. When the shoulder 168 engages the plate 108, the second end 170 of the pin 160 will be substantially located within the bore 112 in the plate 110 and completely disengaged from the rod 48 on the slag control shape 32.

A through bore 190 is formed in the arm assembly 101 by an end plate 191 mounted on the ends of the arms 102 and 104 and spaced from the plate 110. The bore 190 forms a passageway for receiving the hanger or rod 48 attached to and extending outward from a top end of the slag control shape 32. The bore 190 communicates with the bore 112 in the plate 110 through which the second end 170 of the pin 160 extends into the bore 190. The bore 190 in the arm assembly 101 and the bore 42 in the cover 28 are aligned and positioned substantially co-axially above the discharge outlet or well 24 in the molten metal vessel 10.

Figure 10:
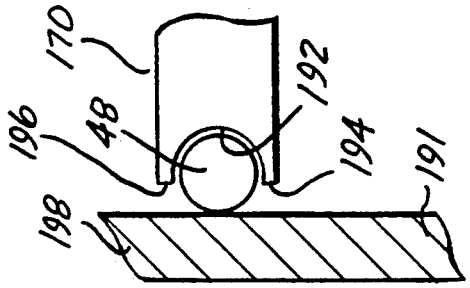
FIG. 10 is an enlarged, plan view of one embodiment of a means for retaining a slag control shape in the apparatus shown in FIGS. 8 and 9.

As shown in FIG. 10, in one embodiment, the second end 170 of the pin 160 is formed with a yoke shape having an arcuate central portion 192 and a pair of end arms 194 and 196 which define an arcuate, open-ended recess therebetween. The radius of the recess is selected to be equal to one-half or slightly less than the diameter of the hanger 48 attached to the slag control shape 32. In this manner, the second end 170 of the pin 160, under the biasing force supplied by the springs 140 and 172, will forcibly engage and hold the hanger 48 on the slag control shape 32 within the bore 190 against the end wall 191 on the arm assembly 101. This retains the slag control shape 32 in the arm assembly 101 of the releasable mounting means 100 as shown in FIG. 8 until its release into the molten metal vessel. The central portion 192 may be provided with a serrated surface in order to more securely engage the hanger 48. Also, the end of the hanger or rod 48 can be slightly flattened to provide added gripping engagement with the pin 170.

Figure 11:
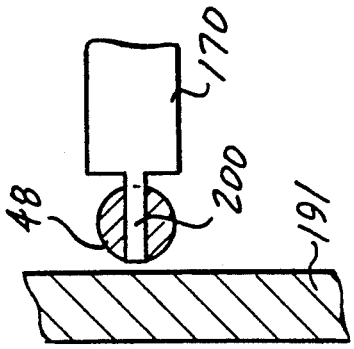
FIG. 11 is an enlarged, plan view of another embodiment of a means for releasably mounting a slag control shape in the apparatus shown in FIGS. 8 and 9.

Another embodiment of the second end 170 of the pin 160 is shown in FIG. 11. In this embodiment, the second end 170 of the pin 160 has a thin pin 200 extending outward from the second end 170 of the pin 160. The pin 200 is adapted to engage a bore or a hoop formed in or attached to the hanger or rod 48 on the slag control shape 32 or directly on the slag control shape 32 to retain the slag control shape 32 in the bore 42 in the cover 28 as shown in FIG. 8. Retraction of the plunger 130 and the pin 160, as described above by a downward force on the cable 60, retracts the thin pin 200 on the second end 170 of the pin 160 from the bore or hoop in the hanger 48 thereby allowing the slag control shape 32 to drop into the molten metal vessel.

Figure 12:
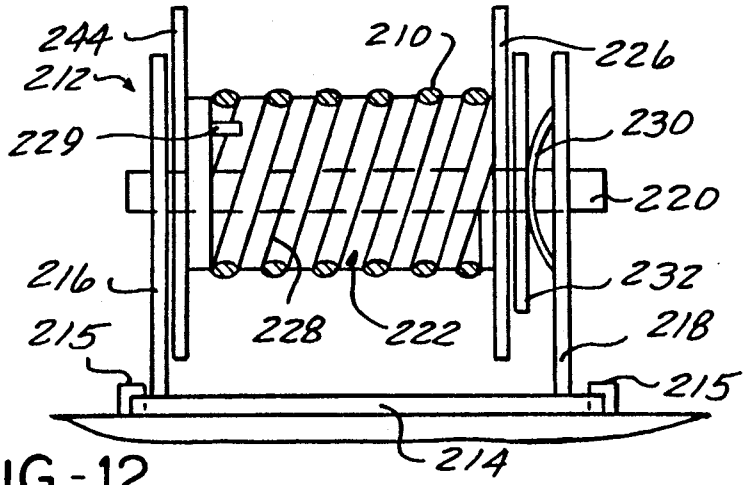
FIG. 12 is a pictorial end view of the cable and reel shown in FIG. 8.

According to a unique feature of the present invention, means is provided for controlling the rate of descent of the slag control shape 32 into the molten metal vessel after release of the slag control shape 32 from the mounting means 100 as described above. As shown in FIGS. 8 and 12, a flexible cable 210 is attached at one end to the hanger 48 on the slag control shape 32 by suitable means, such as by tying for example. The cable 170 may be formed of any suitable material, such as stainless steel wire, carbon steel wire, thermocouple wire, etc..

The other end of the cable 210 is wound in a plurality of turns about a rotatable reel denoted generally by reference number 212. The reel 212, as shown in FIG. 12, includes a base 214 and a pair of upstanding side arms 216 and 218 mounted on and extending upward from the base 214. The base 214 is releasably mounted in a pair of spaced brackets 215 affixed on the cover plate 113 of the arm assembly 101. The brackets 215 form a slot therebetween for slidably receiving the side edges of the base 214 therein. One end of each bracket 215 has an inward extending flange to close the one end and act as a stop for the base 214. A spring-biased latch arm 217 is mounted on the cover plate 113 and is movably biased upward at one end above the top surface of the cover plate 113 to engage one end of the base 214 and to hold the base 214 in a stationary position on the arm assembly 101. A downward force on the outer end of the arm 217 enables the base 214 to be slidably removed from the brackets 215 for replacement, as described hereafter.

A rotatable spindle 220 extends through the arms 216 and 218 and rotatably supports a shaft 222 which is concentrically mounted about the spindle 220. The spindle 220 is held in the arms 216 and 218 by suitable fasteners, such as cotter pins, not shown. The spindle 220 can be removed from the arms 216 and 218 to enable a cable 210 and spindle 220 to be mounted in the reel 212. The shaft 222 includes a pair of enlarged end walls 224 and 226. The shaft 222 may have a smooth shape for receiving the cable 210 thereon in a plurality of wound, overlapping turns. Preferably, however, as shown in FIG. 12, the shaft 222 is formed with a plurality of grooves 228 which are arranged in a spiral configuration along the length of the shaft 222. The grooves 228 are sized to receive one turn of the cable 210 each such that the cable 210 is wound in a plurality of turns, each in a constant diameter across the length of the shaft 222. FIG. 12 is a pictorial representation of the constant diameter grooves, with such grooves being illustrated larger in size and fewer in number than would normally be provided to contain a total cable length of 20 feet or more.

A slot 229, FIG. 12, is formed in the shaft 222 for releasibly receiving one end of the cable 210. The cable 210 is then wound in a plurality of turns about the shaft 222 as described above. In this manner, the cable 220 is releasible from the shaft 222 after it has completely unwound as will occur when the slag control shape 32 is located on the bottom of the vessel 10 and the cover 28 is removed from the vessel 10.

Figure 14:
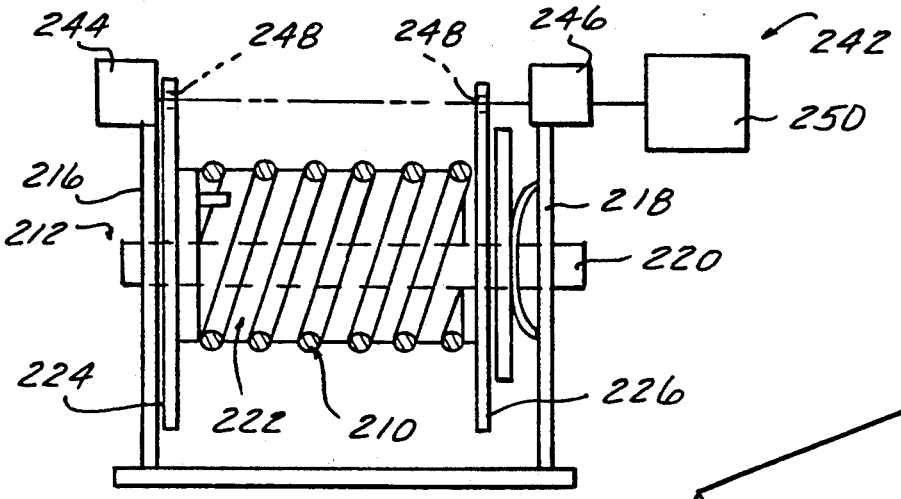
FIG. 14 is an end view of another embodiment of the reel depicting a rotation detector.

By using the constant diameter shaft 222, the length of descent of the slag control shape 32 can be determined by means of a suitable detector or sensor. As shown in FIG. 13, a detector 242 is mounted on the reel 212 and detects the number of rotations of the shaft 222 as the slag control shape 32 descends into the molten metal vessel 10. The number of rotations of the shaft 222 can be used to calculate the length of cable 210 unwound from the shaft 222 so as to provide a measurement of the distance the slag control shape 32 has descended into the molten metal vessel 10 until it reaches the molten metal/slag interface where further descent is halted due to the inherent buoyancy characteristics of the slag control shape 32. When this occurs, further unwinding of the cable 210 from the shaft 222 ceases. However, as molten metal is discharged from the molten metal vessel through the discharge outlet or well 24 shown in FIG. 1, the slag control shape 32 will descend further into the vessel 10 and remain at lower the molten metal/slag interface. This causes further lengths of the cable 210 to unwind from the shaft 222. This distance of unwinding of the cable 210 can be correlated to the amount of molten metal remaining in the vessel 10. Any suitable detector 242 may be employed to detect revolutions of the shaft 222. As shown in FIG. 14, by way of example only, a photoelectric sensor, such as a PZ series sensor sold by Keyence Corporation of America, Fair Lawn, N.J. includes a light beam emitter 244 and a receiver 246 respectively mounted on the arms 216 and 218 of the reel 212. One pair of aligned apertures 248 are formed in the end walls 214 and 226 of the shaft 222. The light beam will pass between the emitter 244 and the receiver 246 once per complete revolution of the shaft 222 when the pair of apertures 248 are aligned between the emitter 244 and the receiver 246. Thus, if the diameter of the shaft 222 is 3.85 inches, for example, each complete revolution of the shaft 222 will equal twelve inches of cable 210 unwound therefrom and twelve inches of descent of the slag control shaft 32 into the vessel 10. The receiver 246 generates an output signal upon detecting each light beam from the emitter 244. The output signal is input to a counter means 250 which, besides counting each signal, is also capable of calculating the length of cable 210 unwound during each revolution of the shaft 222 and/or displaying the length of cable unwinding.

Additional pairs of aligned apertures 248 can be formed in the end walls 224 and 226 at spaced angular positions to increase the resolution of the measurement of the unwinding of the cable 210. Other types of detectors can also be used, such as light reflective detectors in which a tag or patch is mounted on one end wall 224 of the shaft 222 and read or detected by the detector once for each revolution of the shaft 222.

Means are also provided for providing a constant retarding force to the shaft 222 to control the rate of unwinding or payout of the cable 210 from the reel 212. The retarding force means includes a suitable biasing means 230, such as a Belleville washer or washers, which are mounted between the arm 218 and a brake plate 232. The brake plate 232 slidably engages the end wall 226 of the shaft 222. The spring force provided by the washers 230 forces the brake plate 232 into engagement with the end wall 226 and provides a constant frictional force to control the rate of rotation of the shaft 222 and, thereby, the rate of unwinding of the cable 210 and the rate of descent of the slag control shape 32 into the molten metal vessel 10.

A guide member 240 is mounted on the cover plate 113 of the arm assembly 101 at the position adjacent the bore 190 in the arm assembly 101 to guide the cable 210 as it passes from the reel 212 into the bore 190. The guide member 240 is a plate welded or otherwise secured to the cover plate 113 and includes a bore, preferably a slot 241, for receiving the cable 210 therethrough.

In operation, a slag control shape 32 is attached to the slag control shape mounting means 100 after the cover 28 has been removed from the molten metal vessel at the completion of a charge or shot. The cover 28 would normally be placed on the plant floor thereby providing easy access to the slag control shape mounting apparatus 100. The arm assembly 101 is pivoted away from the cover 28, as shown in FIG. 13, by disengaging one end of the arm assembly 101 from the latch 180. During such pivotal movement, the first end 162 of the pin 160 carried in the arm assembly 101 disengages from the recess 152 in the first end 132 of the plunger 130 in the yoke 114.

The arm assembly 101 is raised until it seats against the angled edge of the flanges 120 and 122 on the yoke 114. The hanger 48 of a new slag control shape 32 is then inserted into the recess 190 in the arm assembly 101 and urges the end 170 of the pin to the left until the pin 160 is aligned with the bore in the hanger 48 at which time the pin 160 slides forward to lock the hanger 42 in the arm assembly 101. A length of cable 210 is then unwound from the shaft 222 until the free end of the cable 210 can be attached to one end of the hanger 48 of the slag control shape 32, preferably, by tying to the hanger 42. It should be noted that the free end of the cable 210 will be first passed through the slot 241 in the guide member 240 prior to its attachment to the hanger 48 of the slag control shape 32. The arm assembly is then lowered to a horizontal position, shown in FIG. 8, with the latch means 180 engaging the arm assembly 101 to center the arm assembly 101 in a fixed position on the cover 28. During such downward pivotal movement, the first end 162 of the pin 160 in the arm assembly will reengage the recess 152 in the first end 132 of the plunger 130 to reconnect the pin 160 to the plunger 130.

In summary, there has been disclosed a unique slag control shape release apparatus for use with molten metal vessels which enables a slag control shape or body to be easily inserted into the molten metal vessel at the appropriate time without requiring the use of cranes or the necessity of having the ladleman or another worker climb a stairway to manually insert the slag control shape into the vessel. The apparatus is conveniently mounted on a cover emplaced on the open top end of the vessel so as to easily position the slag control shape in the cover prior to its insertion into the vessel. The apparatus of the present invention simplifies the insertion of slag control shapes into molten metal vessels, such as ladles or tundishes, and enables the ladleman who normally monitors the metal making process utilizing the ladle or tundish to conveniently insert the slag control shape into the molten metal vessel at the appropriate time without disrupting his other duties.

The unique slag control shape release apparatus of the present invention also includes means for controlling the descent and, particularly, the rate of descent of the slag control shape into a molten metal vessel. This ensures that the slag control shape remains centered over the discharge outlet of the molten metal vessel so as to enable the slag control shape to consistently engage the discharge outlet or well at the proper time to prevent the discharge of slag through the discharge outlet. The controlled rate of descent of the slag control shape provided by the apparatus of the present invention ensures that the slag control shape remains centered over the discharge outlet and does not move away from a centered position above the discharge outlet prior to the formation of a vortex above the discharge outlet when the molten metal/slag interface reaches a low level in the molten metal vessel.

Finally, the provision of a cable reel rotation detector and counter uniquely provides an indication of the amount of molten metal remaining in the vessel by determining the length of cable paid out from the reel as the slag control shape, which buoyantly floats at the slag/molten metal interface, descends into the vessel as molten metal is discharged therefrom.

What is claimed is:

1. A slag control shape release apparatus for a molten metal receptacle having an open top, side and bottom walls, an interior cavity containing a layer of slag covering a layer of molten metal, a discharge nozzle formed in the bottom wall, a cover removably closing the open top end of the receptacle, the cover having a bore extending therethrough and a slag control shape insertable into the receptacle, the apparatus comprising:

means, mounted on the cover, for releasably mounting the slag control shape adjacent to the cover;

means, connected to the mounting means, for actuating the mounting means to release the slag control shape from the mounting means on the cover and to allow the descent of the slag control shape by gravity into the molten metal receptacle, the actuating means being operable from a location remote from the cover mounted on the molten metal receptacle; and means, attached to the slag control shape, for automatically controlling the rate of descent of the slag control shape into the molten metal receptacle after release of the slag control shape from the mounting means.

2. The apparatus of claim 1 wherein the descent controlling means comprises:

a reel mounted on the cover;

a rotatable shaft mounted in the reel; and a flexible cable wound in a plurality of turns around the shaft and attached at one end to the slag control shape.

3. The apparatus of claim 2 further comprising:

means for automatically maintaining the rate of rotation of the shaft constant after release of the slag control shape from the mounting means.

4. The apparatus of claim 3 wherein the constant rotation rate maintaining means comprises:

a plate movably disposed adjacent to one end of the shaft; and biasing means for urging the plate into engagement with the shaft at a predetermined frictional force to provide a constant resistance to rotation of the shaft.

5. The apparatus of claim 1 wherein the mounting means comprises:

a yoke mounted on the cover;

a bore formed in the yoke;

a plunger movably mounted in the bore having first and second ends;

biasing means, mounted in the bore about the plunger, for normally biasing the first end of the plunger outward from the yoke;

an arm pivotally attached to the yoke;

a pin slidably mounted in the arm and having first and second ends, the first end of the pin releasably engaging the first end of the plunger of the yoke;

biasing means, mounted in the arm about the pin, for normally biasing the second end of the pin outward from the arm;

a bore formed in the arm for releasably receiving a slag control shape therein; and the second end of the pin releasably engaging the slag control shape mounted in the arm to hold the slag control shape in the arm and being retractable away from the slag control shape to release the slag control shape for descent into a molten metal receptacle below the cover.

6. The apparatus of claim 5 further comprising:

another flexible cable having a first end connected to the plunger;

the another cable having a second end located remote from the plunger at an easily accessible position for retraction of the plunger and the pin from the first position to a second, retracted position in which the pin separates from the slag control shape and allows the slag control shape to descend into the molten metal receptacle.

7. The apparatus of claim 5 wherein:

the bore in the arm is co-axially disposed above the bore in the cover and the discharge nozzle in the molten metal vessel when the cover is mounted on the molten metal receptacle.

8. The apparatus of claim 2 wherein the reel further comprises:

a pair of spaced support arms mounted on the mounting means;

a spindle mounted between the pair of support arms; and the shaft rotatably mounted on the spindle between the pair of support arms.

9. The apparatus of claim 2 wherein the shaft has a plurality of spirally connected grooves formed thereon, each groove receiving one turn of the flexible cable.

10. The apparatus of claim 5 wherein the second end of the pin has an open-ended recess formed therein, the recess engaging the hanger of the slag control shape and holding a hanger against an adjacent surface of the arm.

11. The apparatus of claim 5 wherein the second end of the pin releasably engages a bore formed in a hanger of the slag control shape to hold the hanger in the arm.

12. The apparatus of claim 2 further comprising:

means for detecting the number of revolutions of the shaft as the cable is unwound from the shaft after release of the slag control shape from the mounting means.

13. The apparatus of claim 12 wherein the detecting means comprises:

sensor means or sensing each rotation of the shaft; and means, responsive to the sensor means, for counting each revolution of the shaft.

14. The apparatus of claim 13 wherein the shaft has a plurality of spirally connected grooves formed thereon, each groove receiving one turn of the flexible cable therein.

15. The apparatus of claim 14 further comprising:

means, responsive to the sensor means, the counting means and the predetermined diameter of the grooves in the shaft, for calculating the length of flexible cable unwound from the shaft after the slag control shape is released from the mounting means.

16. A slag control shape release apparatus for a molten metal receptacle having an open top, side and bottom walls, an interior cavity containing a layer of slag covering a layer of molten metal, a discharge nozzle formed in the bottom wall, a cover removably closing the open top end of the receptacle, the cover having a bore extending therethrough and a slag control shape insertable into the receptacle, the apparatus comprising:

means, mounted on the cover, for releasably mounting the slag control shape with respect to the cover;

means, connected to the mounting means, for actuating the mounting means to release the slag control shape from the mounting means on the cover and to allow the descent of the slag control shape by gravity into the molten metal receptacle, the actuating means being operable from a location remote from the cover mounted on the molten metal receptacle;

the mounting means including:

a yoke mounted on the cover;

a bore formed in the yoke;

a plunger movably mounted in the bore and having first and second ends;

first biasing means, mounted in the bore for normally biasing the first end of the plunger outward from the yoke;

an arm pivotally attached to the yoke;

a pin slidably mounted in the arm and having first and second ends, the first end of the pin releasably engaging the first end of the plunger of the yoke;

a bore formed in the arm for releasably receiving a slag control shape therein;

second biasing mean, mounted in the arm for normally biasing the second end of the pin into the bore in the arm; and the second end of the pin releasably engaging the slag control shape disposed in the bore in the arm to hold the slag control shape in the arm and being retractable away from the slag control shape to release the slag control shape for descent into a molten metal receptacle below the cover.

17. The apparatus of claim 16 further comprising:

a reel mounted on the cover;

a rotatable shaft mounted in the reel; and a flexible cable wound in a plurality of turns around the shaft and attached at one end to the slag control shape.

18. The apparatus of claim 16 wherein:

the bore in the arm is co-axially disposed above the bore in the cover and the discharge nozzle in the molten metal receptacle when the cover is mounted on the molten metal receptacle.

19. The apparatus of claim 16 wherein the second end of the pin has an open-ended recess formed therein, the recess engaging the hanger of the slag control shape and holding a hanger against an adjacent surface of the arm.

20. The apparatus of claim 16 wherein the second end of the pin releasably engages a bore formed in a hanger of the slag control shape to hold the hanger in the arm.

21. A molten metal receptacle containing a layer of slag covering a layer of molten metal, the receptacle having an open top end, side and bottom walls and a discharge nozzle formed in the bottom wall, the molten metal receptacle comprising:

a cover for removably closing the open top end of the receptacle;

a bore formed in the cover, the bore being located substantially over the discharge nozzle when the cover is mounted on the receptacle;

a slag control shape having a specific gravity to buoyantly float at an interface between the slag layer and the molten metal layer;

means, mounted on the cover, for releasably mounting the slag control shape adjacent to the cover;

means, connected to the mounting means, for actuating the mounting means to release the slag control shape from the cover and to allow the descent of the slag control shape by gravity into the molten metal receptacle, the actuating means being operable form a location remote from the cover mounted on the molten metal receptacle; and means, attached to the slag control shape, for automatically controlling the rate of descent of the slag control shape into the molten metal receptacle after release of the slag control shape from the mounting means.

22. The molten metal receptacle of claim 21 wherein the descent controlling means comprises:

a reel mounted on the cover;

a rotatable shaft mounted in the reel; and a flexible cable wound in a plurality of turns around the shaft and attached at one end to the slag control shape.

23. The molten metal receptacle of claim 22 further comprising:

means for automatically maintaining the rate of rotation of the shaft constant after release of the slag control shape from the mounting means.

24. The molten metal receptacle of claim 23 wherein the constant rotation rate maintaining means comprises:

a plate movably disposed adjacent to one end of the shaft; and biasing means for urging the plate into engagement with the shaft at a predetermined frictional force to provide a constant resistance to rotation of the shaft.

25. The molten metal receptacle of claim 21 wherein the mounting means comprises:

a yoke mounted on the cover;

a bore formed in the yoke;

a plunger movably mounted in the bore having first and second ends;

biasing means, mounted in the bore about the plunger, for normally biasing the first end of the plunger outward from the yoke;

an arm pivotally attached to the yoke;

a pin slidably mounted in the arm and having first and second ends, the first end of the pin releasably engaging the first end of the plunger of the yoke;

biasing means, mounted in the arm about the pin, for normally biasing the second end of the pin outward from the arm;

a bore formed in the arm for releasably receiving a slag control shape therein; and the second end of the pin releasably engaging the slag control shape mounted in the arm to hold the slag control shape in the arm and being retractable away from the slag control shape to release the slag control shape for descent into a molten metal receptacle below the cover.

26. The molten metal receptacle of claim 25 further comprising:

another flexible cable having a first end connected to the plunger;

the another cable having a second end located remote from the plunger at an easily accessible position for retraction of the plunger and the pin from the first position to a second, retracted position in which the pin separates from the slag control shape and allows the slag control shape to descend into the molten metal receptacle.

27. The molten metal receptacle of claim 25 wherein:

the bore in the arm is co-axially disposed above the bore in the cover and the discharge nozzle in the molten metal vessel when the cover is mounted on the molten metal receptacle.

28. The molten metal receptacle of claim 22 wherein the reel further comprises:

a pair of spaced support arms mounted on the mounting means;

a spindle mounted between the pair of support arms; and the shaft rotatably mounted on the spindle between the pair of support arms.

29. The molten metal receptacle of claim 22 wherein the shaft has a plurality of spirally connected grooves formed thereon, each groove receiving one turn of the flexible cable.

30. The molten metal receptacle of claim 25 wherein the second end of the pin has an open-ended recess formed therein, the recess engaging the hanger of the slag control shape and holding a hanger against an adjacent surface of the arm.

31. The molten metal receptacle of claim 25 wherein the second end of the pin releasably engages a bore formed in a hanger of the slag control shape to hold the hanger in the arm.

32. The molten metal receptacle of claim 22 further comprising:

means for detecting the number of revolutions of the shaft as the cable is unwound from the shaft after release of the slag control shape from the mounting means.

33. The molten metal receptacle of claim 32 wherein the detecting means comprises:

sensor means for sensing each rotation of the shaft; and means, responsive to the sensor means, for counting each revolution of the shaft.

34. The molten metal receptacle of claim 33 wherein the shaft has a plurality of spirally connected grooves formed thereon, each groove receiving one turn of the flexible cable therein.

35. The molten metal receptacle of claim 34 further comprising:

means, responsive to the sensor means, the counting means and the predetermined diameter of the grooves in the shaft, for calculating the length of flexible cable unwound from the shaft after the slag control shape is released from the mounting means.

* * * * *